US007396510B2

(12) United States Patent
Zengerle et al.

(10) Patent No.: US 7,396,510 B2
(45) Date of Patent: Jul. 8, 2008

(54) DEVICE AND METHOD FOR DOSING SMALL AMOUNTS OF LIQUID

(76) Inventors: Roland Zengerle, Am Schänzle 3, 79183 Waldkirch (DE); Peter Koltay, Benzhauserstrasse 5, 79232 March (DE)

( * ) Notice: Subject to any disclaimer, the term of this patent is extended or adjusted under 35 U.S.C. 154(b) by 732 days.

(21) Appl. No.: 10/250,607

(22) PCT Filed: Jan. 10, 2002

(86) PCT No.: PCT/EP02/00186

§ 371 (c)(1),
(2), (4) Date: Jul. 7, 2003

(87) PCT Pub. No.: WO02/057015

PCT Pub. Date: Jul. 25, 2002

(65) Prior Publication Data

US 2004/0074557 A1 Apr. 22, 2004

(30) Foreign Application Priority Data

Jan. 18, 2001 (DE) ..... 101 02 152

(51) Int. Cl.
*B01L 3/02* (2006.01)

(52) U.S. Cl. ..... 422/100; 422/99; 422/101; 422/102; 222/52; 222/71; 222/80; 347/20; 436/180

(58) Field of Classification Search ..... 422/99–101; 436/180; 222/82, 214, 52, 71, 80; 347/20
See application file for complete search history.

(56) References Cited

U.S. PATENT DOCUMENTS 4,537,231 A * 8/1985 Hasskamp ..... 141/238
5,593,290 A * 1/1997 Greisch et al. ..... 417/478
6,116,297 A * 9/2000 Feygin ..... 141/31
6,354,471 B2 * 3/2002 Fujii ..... 222/380

FOREIGN PATENT DOCUMENTS

DE 199 17 029 A1 11/2000

OTHER PUBLICATIONS

International Examination Report dated Apr. 5, 2004.

* cited by examiner

*Primary Examiner*—Jill Warden
*Assistant Examiner*—Jyoti Nagpaul
(74) *Attorney, Agent, or Firm*—Thomas, Kayden, Horstemeyer & Risley, LLP.

(57) ABSTRACT

A microdosage device comprises a media reservoir used for accommodating a liquid to be dosed, a nozzle connected via a connecting channel to the media reservoir and adapted to be filled via said connecting channel with the liquid to be dosed, and a drive unit for applying, when actuated, to a liquid contained in the media reservoir and in the nozzle a force of such a nature that a substantially identical pressure will be exerted on said liquid contained in the media reservoir and in the nozzle. Flow resistances of the connecting channel and of the nozzle are dimensioned such that, in response to an actuation of the drive unit, a volumetric flow in the connecting channel will be small in comparison with a volumetric flow in the nozzle, said volumetric flow in the nozzle causing an ejection of the liquid to be dosed from an ejection opening of the nozzle.

17 Claims, 6 Drawing Sheets

DEVICE AND METHOD FOR DOSING SMALL AMOUNTS OF LIQUID

BACKGROUND OF THE INVENTION

1. Field of the Invention

The present invention relates to devices and methods for dosing small amounts of liquid, and in particular to devices and methods which are suitable for simultaneously and accurately discharging small or extremely small amounts of dosed liquid from a plurality of parallel channels.

2. Description of Prior Art

The accurate dosing of amounts of liquid is of essential importance e.g. in the fields of pharmaceutical and biotechnological research, e.g. in the field of genomics, high-throughput screening, combinatorial chemistry and the like. Such dosing is e.g. necessary for filling so-called well-plates with reagents. In order to realize such filling various devices and methods are known at present; the most common ones of these devices are air-cushion pipettes, valve-controlled piston-displacement pipettes, piezoelectric pipettes and needle pipettes. The devices referred to are typically of the single-channel type. Part of these devices can, however, also be arranged in a raster so that parallel channels are provided. The highest degree of parallelization achieved is, at present, 384 channels in the case of some commercially available devices used for dosing volumes above 0.5 μl.

When the above-mentioned principles and devices are used for filling well-plates, one or a plurality of the problems mentioned hereinbelow frequently occur(s). In most cases, it is impossible to discharge dosing volumes which are smaller than 500 nl. This applies especially to air-cushion pipettes. In addition, the accuracy of all commercially available devices is unsatisfactory in the lower dosing range, the error exceeding typically 10%. Furthermore, due to the structural design of the conventional devices, it is impossible to achieve a high level of integration, e.g. raster dimensions of less than 4.5 mm, by said devices so that serial processing has to be carried out in some cases. Only needle pipettes are suitable for achieving also raster dimensions which are as small as 2.25 mm. If dosage is not effected in the form of a free jet, as e.g. in the case of needle pipettes, displacements and cross-contaminations of the liquids to be dosed may occur.

Known microdosage devices are described in DE-A-19706513 and in DE-A-19802368. These known devices are based on a functional principle according to which a liquid to be dosed has applied thereto an acceleration by a displacer within a pressure chamber. The pressure chamber is in fluid connection with an outlet opening and with a fluid reservoir. It follows that, when the displacer these known devices is operated, a movement of the liquid through the outlet opening as well as back into the reservoir will take place.

DE-A-19913076 discloses a microdosage device by means of which a plurality of microdroplets can be applied to a substrate; in this microdosage device the whole dosing head is acted upon by an acceleration. Due to this acceleration of the whole dosing head, an inertia-dependent relative acceleration between the fluid contained and the dosing head is achieved, said relative acceleration being of such a nature that droplets are ejected from the respective nozzle openings.

Finally, WO 00/62932 discloses methods and devices for discharging extremely small, dosed amounts of liquids, the discharge amounts mentioned being in the range of from 0.1 nl to 100 μl. According to this publication a capillary is used, which is provided with a discharge opening and which has connected thereto at least one gas line via a junction point. Via the capillary, a gas blast is introduced in the gas line so that an amount of liquid contained in the capillary section between the junction point and the discharge opening will be discharged from the discharge opening in a dosed amount. This publication also mentions the possibility of producing a pipetting array making use of a plurality of dosage devices of the type described hereinbefore. Also in the dosage devices disclosed in this publication a return flow into the reservoir takes place and, in the most disadvantageous case, air bubbles may rise into the reservoir line and block it.

The above-mentioned disadvantages result in the fact that the time which is necessary to fill a well-plate is normally considered to be too long for the desired throughput. This results, on the one hand, in high costs and, on the other hand, partly also in difficulties as far as the analysis of the reaction products is concerned, if the reactions in the individual reservoirs of the well-plate start with a time shift.

In R. Zengerle, "Mikrosysteme—Chancen für die Dosiertechnik", wägen+dosieren 1/1996, pp. 10-15, micropumps for microdroplet injectors are disclosed in the case of which the volume of a pump chamber can be varied by means of a diaphragm which is adapted to be driven by a piezo bending transducer. An inlet opening and an outlet opening of the pressure chamber are provided. A pumping effect can be achieved in response to actuation of the diaphragm, in that either the inlet opening and the outlet opening are provided with a non-retum valve or in that a buffer is provided adjacent the pressure chamber.

DE 19648694 C1 discloses a bidirectional dynamic micropump comprising a pump chamber as well as an inlet and an outlet for the pump chamber with different flow resistances. A diaphragm borders on the pump chamber, whereby the delivery direction of the micropump can be controlled by suitably shaping the control pulse for the diaphragm.

WO 97/15394 discloses a plate having a plurality of apertures which extend therethrough. The apertures have a large opening towards one surface of the plate and a small nozzle opening towards the opposite surface of said plate. By applying a pressure on the large opening, a jet of liquid can be ejected through the small nozzle opening.

Another dosage device is known from WO 99/36176, said dosage device comprising a liquid reservoir and a channel which is in fluid communication with the liquid reservoir. Openings are formed in opposed walls of the channel so that the liquid present between the openings can be discharged, in a dosed amount, by applying a pressure to one of the openings.

SUMMARY OF THE INVENTION

It is the object of the present invention to provide devices and methods for dosing small amounts of liquid, which permit a simple structural design of a microdosage device and which additionally permit an accurate, precise dosage of small amounts of liquid from a plurality of parallel channels.

According to a first aspect of the invention, this object is achieved by a microdosage device having the following features:

a media reservoir used for accommodating a liquid to be dosed;

a nozzle connected via a connecting channel to the media reservoir and adapted to be filled via said connecting channel with the liquid to be dosed; and a drive unit for applying, when actuated, to a liquid contained in the media reservoir and in the nozzle a force of such a nature that a substantially identical pressure will be exerted on said liquid contained in the media reservoir and in the nozzle, wherein flow resistances of the connecting channel and of the nozzle are dimensioned such that, in response to an actuation of the drive unit, a volumetric flow in the connecting channel will be small in comparison with a volumetric flow in the nozzle, said volumetric flow in the nozzle causing an ejection of the liquid to be dosed from an ejection opening of the nozzle.

According to a second aspect of the invention, the above object is achieved by a method for dosing small amounts of liquid, said method comprising the following steps:

filling at least one nozzle via a connecting channel with a liquid to be dosed from a media reservoir, said connecting channel establishing a fluid connection between said nozzle and said media reservoir;

applying to the liquid contained in the media reservoir and in the nozzle a force of such a nature that a substantially identical pressure will be applied to the liquid contained in the media reservoir and in the nozzle, so that, due to the dimensioning of flow resistances of the connecting channel and of the nozzle, the volumetric flow in the connecting channel will be small in comparison with the volumetric flow of the liquid in the nozzle so as to eject an amount of the liquid to be dosed from an ejection opening of the nozzle.

The functional principle of the microdosage device according to the present invention and of the method for dosing small amounts of liquid according to the present invention is based on two points; firstly, that the reservoir and the nozzle and nozzle channel, respectively, have simultaneously applied thereto a force, and secondly that the reservoir and the nozzle are separated from one another to a sufficient extent by the connecting channel. The higher the fluidic resistance of the connecting channel in relation to the fluidic resistance of the nozzle channel is, the more effective such a separation will be. Due to the fluidic separation, the maximum amount dosed in the case of the present invention will be the volume contained in the nozzle; when this volume has been discharged, the dosing operation will stop automatically.

According to the present invention, the reservoir, the nozzle and the connecting channel are preferably formed in a dosing head; such a dosing head may preferably comprise a plurality of reservoirs, nozzles and connecting channels. In order to cause an ejection of droplets from the nozzle opening or the nozzle openings of said one or of said plurality of nozzles, a driving force is applied to the whole liquid contained in the dosing head in accordance with the present invention, i.e. both the reservoir and the nozzle are acted upon by this force. This is the reason for the fact that a return flow into the reservoir does not take place in the case of the present invention, another reason being that the pressure gradient along the connecting line is negligible.

In preferred embodiments of the present invention the reservoirs as well as the nozzles are arranged in a raster which corresponds to the format of a well-plate. Furthermore, the reservoirs and the nozzles may be arranged in different rasters so that a change of format between the format of the reservoirs and that of the receiving receptacle, which is normally a well-plate, is effected by a dosing process. The dosing head used in the microdosage device according to the present invention can be produced in a conventional, known manner making use of micro-mechanical methods; it can be produced from silicon or from plastic material, by way of example, making use of e.g. an injection moulding technology. In preferred embodiments the drive means consists of a pneumatic or a hydraulic drive unit comprising a pressure chamber that can rapidly be filled with a gas or a liquid as a buffer medium so as to apply the necessary force to the reservoirs and the nozzles.

According to the present invention, the reservoirs and the reservoir ends located opposite the ejection ends of the nozzles are preferably formed in a surface of the dosing head so that the whole first side of the dosing head and of the dosing head substrate, respectively, can be acted upon by the driving force; this application of force will have the effect that only the liquid contained in the nozzle, i.e. the nozzle channel and the nozzle opening, will be discharged and that the dosing process will stop automatically as soon as the liquid contained in these elements has been discharged. Making use of this principle, a spatial separation of the areas in which the nozzles and the reservoirs are arranged is no longer necessary, whereby the levels of integration that can be achieved will be substantially higher than those achieved by devices in which the driving force only acts on the rear nozzle areas, but not on the reservoirs.

It follows that the present invention provides devices and methods by means of which liquids can be discharged e.g. into a well-plate in a highly parallel mode. The microdosage device according to the present invention has therefore a simple structure but, nevertheless, it permits exact dosage even if the system realized is a highly integrated dosing system in which parallel dosage is to be carried out making use of e.g. 1536 parallel nozzles. According to the present invention, such precise dosage can be carried out without making use of active or passive valves, which are used in the prior art in some cases, since the reservoirs as well as the nozzles are acted upon by the force and since the connecting channel between these elements has a suitable structural design.

Hence, the present invention represents a substantial improvement of dosing technology in the nanolitre range, which permits a highly parallel and therefore a much faster dosage of reagents into well-plates. The present invention allows a high degree of parallelization and a high level of integration; it is, for example, possible to carry out 96, 384, 1536 or more dosing processes simultaneously in the case of raster dimensions of 9.0 mm, 4.5 mm, 2.25 mm or raster dimensions which are smaller than that. In addition, the present invention also permits an adaptation to formats outside of the standard for well-plates. The present invention also permits an extremely high accuracy of dosage, the dosing volume error being less than 5 nl in the case of typical dosing amounts of from 50 nl to 100 nl. Due to the contact-free discharge in a free jet, a displacement of media is additionally excluded. As has already been mentioned, re-formatting, e.g. from a 384 format to a 1536 format, can be carried out in parallel when the device is provided with a suitable structural design.

Furthermore, the present invention allows media to be stored in the dosing head so that it is no longer necessary to perform the operating step of transferring the media from the storage unit, which is nowadays typically a well-plate having 96 reservoirs, to the automatic dosage device, which consists nowadays of air-cushion pipettes or of similar devices arranged in parallel. Finally, the dosed volume is largely independent of the physical properties of the liquids used in the case of the device according to the present invention and the method according to the present invention. The present invention also permits the construction of a microdosage device in which the dosing head can be replaced easily so that the drive unit, which is normally more complicated and more expensive than the dosing head itself, can be used for a large number of different dosing heads. In this respect, it is, in particular, also of advantage that the entire first surface of the dosing head is acted upon by the force so that an adaptation is here not necessary, not even in the case of different arrangements of reservoirs and nozzles in different dosing heads.

Hence, the present invention is particularly suitable for discharging precise amounts of liquids into well-plates having standardized outer dimensions and comprising a large number of juxtaposed reservoirs. As has been stated hereinbefore, such well-plates comprise a large number of reservoirs, e.g. 96, 384, 1536 or more, the raster distances between the reservoirs being, accordingly, 9 mm, 4.5 mm, 2.25 mm, etc. Depending on the integration level, the volume of the reservoirs is approx. 100 μl, 20 μl, 4 μl, etc. In these reservoirs chemical and biochemical reactions are caused to take place and the reaction products are analyzed. The possibility of precisely filling well-plates with predetermined amounts of liquid is therefore an indispensable prerequisite for executing quantitative analyses making use of very small amount of liquids; the present invention specially offers this possibility in an advantageous manner.

In addition to precise filling of the well-plate, also a fast, preferably simultaneous dosage of reagents into all reservoirs is of interest, since, normally, a high number of reactions are caused to take place in a well-plate simultaneously. It will here be of advantage when the whole sequence of steps carried out for filling the well-plate and for analyzing the results can be automated, so that several hundred well-plates can be processed per day and so that a few thousand up to one hundred thousand reactions can be caused to take place. Due to the fact that the present invention has the property of allowing a strongly parallel and highly precise dosage of very small amounts of liquids, it is particularly suitable for this purpose, especially also for discharging a great variety of different liquids into the various reservoirs of a well-plate.

BRIEF DESCRIPTION OF THE DRAWINGS

In the following, preferred embodiments of the present invention will be explained in detail making reference to the drawings enclosed, in which.

DESCRIPTION OF PREFERRED EMBODIMENTS OF THE INVENTION

Figure 1:
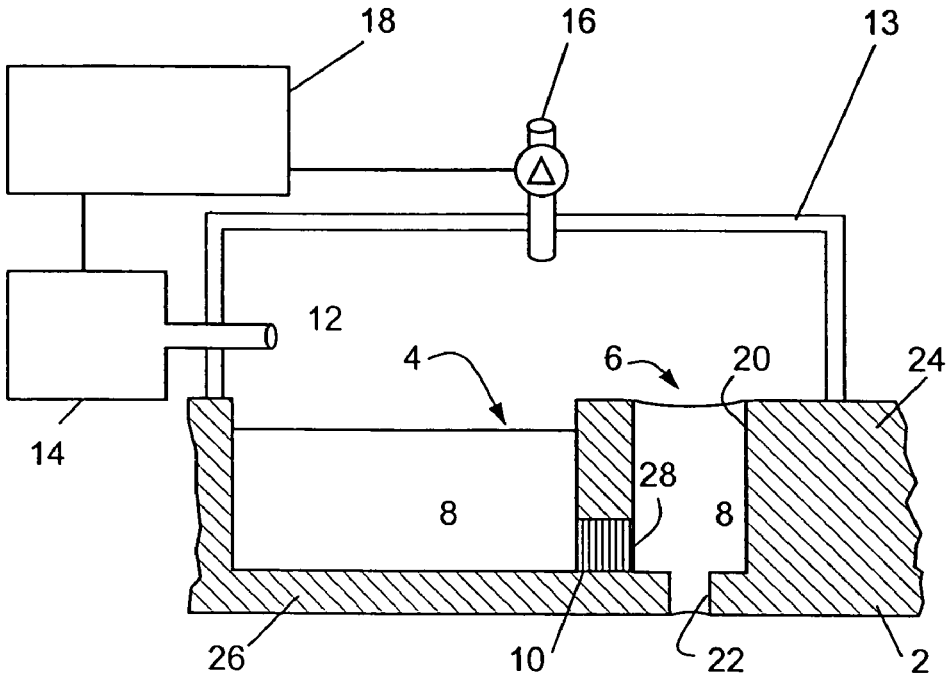
FIG. 1 shows a schematic view of a microdosage device according to the present invention, part of this view being shown in cross-section.

FIG. 1 shows a detail of a dosing head 2 which is part of an embodiment of a microdosage device according to the present invention. The dosing head 2 has formed therein a media reservoir 4 and a nozzle 6 which are filled with a liquid 8 to be dosed. The media reservoir 4 and the nozzle 6 are in fluid connection with one another via a connecting channel 10. The microdosage device additionally includes a drive unit which, in the embodiment shown in FIG. 1, comprises a pressure chamber 12, a housing 13 for the pressure chamber 12 and a unit 14 for applying a pressure to the pressure chamber. This unit 14 can be a conventional pump or a pneumatic valve provided with a suitable feed line to the pressure chamber 12. Furthermore, a vent means 16 for venting the pressure chamber 12 is provided in the embodiment shown. The pressure generation means 14 and the vent means 16 are connected to a controller 18 controlling these two components so as to eject droplets from the nozzle 6.

As can be seen in FIG. 1, the nozzle 6 shown in this figure comprises a nozzle channel 20 and a nozzle opening 22, the cross-section of the nozzle channel 20 being larger than that of the nozzle opening 22. The opening of the nozzle channel located opposite the nozzle opening 22 can be referred to as actuating opening. The nozzle opening 22 is dimensioned such that, in a state of rest, the surface tension of the liquid at the nozzle opening 22 will prevent flowing out of said liquid. The nozzle channel 20 is implemented such that it is completely filled with liquid due to the capillary force.

As shown in the figure, the media reservoir 4 is arranged on a first side of the dosing head 2, i.e. it is formed in a first surface thereof, whereas the discharge of liquid takes place through the nozzle opening 22 on the opposite, second side of the dosing head. The unit which is here referred to as nozzle is defined by the nozzle channel 20 and the nozzle discharge opening 22 and represents a fluid connection between the first surface 24 and the second, opposite surface 26 of the dosing head 2. In the embodiment shown in FIG. 1, the connecting channel 10 connects the media reservoir 4 and the nozzle 6 at the junction portion 28 in the lower area of the nozzle channel 20.

Figure 2:
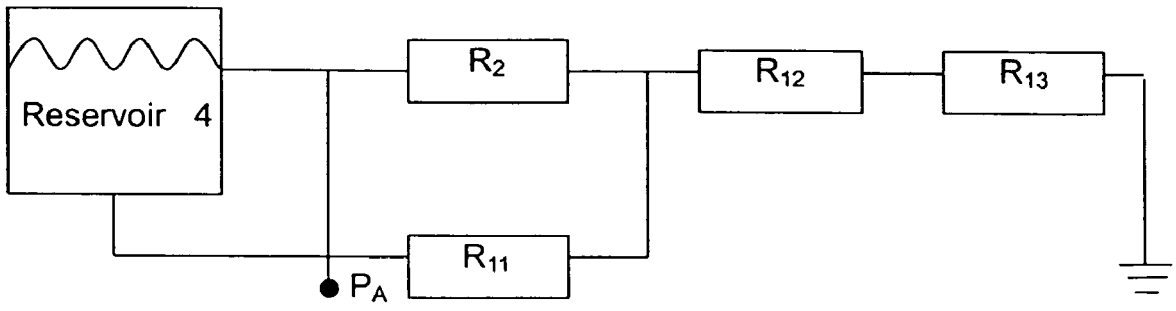
FIG. 2 shows a network model of the microdosage device shown in FIG. 1.

FIG. 2 shows a network model of the dosing head shown in FIG. 1; PA stands for the pressure difference between the upper side 24 and the bottom side 26 of the dosing head 2, this pressure difference being produced by the force applied by means of the drive unit 12, 13, 14. In FIG. 2, the resistance R2 represents the flow resistance of the connecting channel 10. Due to the fact that the connecting channel 28 leads into the nozzle channel 20, the nozzle channel 20 can be subdivided into three subsections; each of these subsections can have associated therewith a flow resistance. The flow resistance R11 is associated with the nozzle channel section between the first side 24 of the dosing head 2 and the point where the connecting channel 10 leads into the nozzle channel. The flow resistance R12 is associated with the subsection between the point where the connecting channel 10 leads into the nozzle channel 20 and the nozzle opening 22. Finally, the flow resistance R13 is associated with the nozzle discharge opening 22 itself. FIG. 2 shows the fluidic connection of the above-explained flow resistances and the connection of these flow resistances with the reservoir 4 as well as the pressure PA produced. These connections result in the fluidic network model shown, whose behaviour is similar to that of a respective electric network.

According to the present invention, the flow resistances of the connecting channel 10 and of the nozzle, i.e. of the nozzle channel 20 and of the nozzle opening 22, are dimensioned such that, when a liquid 8 in the media reservoir and in the nozzle is acted upon by a force of such a nature that a substantially identical pressure is applied to the liquid in the media reservoir and in the nozzle, a volumetric flow in the connecting channel 10 will be small in comparison with a volumetric flow in the nozzle 6.

This situation can be achieved when the flow resistance R2 of the connecting channel 10 is large in comparison with the flow resistance of the nozzle channel between the first side 24 and the second side 26 of the dosing head 2, i.e. when it is equal to R11+R12+R13. Furthermore a sufficiently good dosing quality can already be achieved in the embodiment shown in FIG. 1, when the condition R2>>R11 is fulfilled. In order to make this clear, reference is again made to FIG. 2, where the respective fluidic network is shown. The condition R2>>R11 has the effect that, in spite of an application of pneumatic pressure to the entire first side 24 of the dosing head 2, e.g. by means of the above-described drive unit 12, 14, the pressure difference applied via the connecting channel 10 is negligible. The movement-of the liquid in the connecting channel is therefore negligible as well. Hence, the pressure difference between the first and the second side of the dosing head only has the effect that the amount of liquid contained in the nozzle 6 is discharged to the outside through the nozzle opening 22.

As has already been mentioned hereinbefore, an exact dosage can be achieved by dimensioning the flow resistance R2 of the connecting channel such that it is much higher than the overall resistance of the nozzle channel. In cases in which the connecting channel 10 leads into the nozzle channel 20 in spaced relationship with the first side 24, so that a resistance R11 can be defined, a sufficiently good result will already be achieved when the condition R2>>R11 is fulfilled. With respect to the dimensioning of the resistances R11 and R2 it should be taken into account that the larger the difference between the resistances is the larger the bandwidth of the various liquids which, making use of a suitable dosage device, can be dosed with sufficient accuracy will be.

With respect to the dimensioning of the resistances R11 and R2, it should be taken into consideration that the dosed volume depends on the ratio of the two resistances. If R2/R11≈10 is chosen, the dosed volume will correspond to the liquid volume contained in the nozzle with a systematic deviation of 10% at the most. This deviation results from the fact that, due to the pressure drop across the flow resistance R11, the pressure prevailing at the location where the connecting channel leads into the nozzle will be lower than the pressure prevailing on the upper side, i.e. the first side, of the dosing head and in the reservoir, respectively. This has the effect that a pressure difference across the connecting channel will occur whose magnitude depends on the ratio of the flow resistances R2 and R11, said pressure difference inducing an additional volumetric flow in the connecting channel in the direction of the nozzle opening. This volumetric flow contributes to the dosed volume as well. The exact magnitude of this systematic deviation depends on the details of the concrete structural design of the connecting channel and of the nozzle channel. The deviation can be minimized by a skilful geometrical design of the channels especially at the junction point of these channels. The percentage to which the induced flow contributes to the overall flow through the nozzle and the nozzle opening, respectively, can, however, be estimated with the value R11/R2 towards the upper limit independently of these geometrical details. It follows that, due to the additional flow through the connecting channel, the dosing volume will at most increase to (1+R11/R2) times the volume of the nozzle channel.

Since the process described hereinbefore is, however, reproducible and since the ratio of the flow resistances does not depend on the media properties of the fluid, the accuracy and the functional efficiency of the dosage device will not be impaired by this increase. It follows that the exact ratio of the flow resistances is not of essential importance, as long as R11<R2. Summarizing, it can be stated that the ratio of the flow resistances causes a systematic error which can be compensated for when dosage devices are being produced. It does, however, not cause any statistical error which would influence the reproducibility of the dosage device. With respect to a simple and precise implementation of the dosage device, it may, in practice, be desirable to define the dosing volume as precisely as possible by the volume contained in the nozzle. In this case, it will advantageous to choose R11/R2 as small as possible and R2/R11 as large as possible, e.g. R2/R11>100. This will lead to excellent fluidic decoupling between the nozzle and the reservoir during a dosing operation and the dosed volume will correspond to the nozzle volume with a maximum deviation of 1%.

Figure 3A:
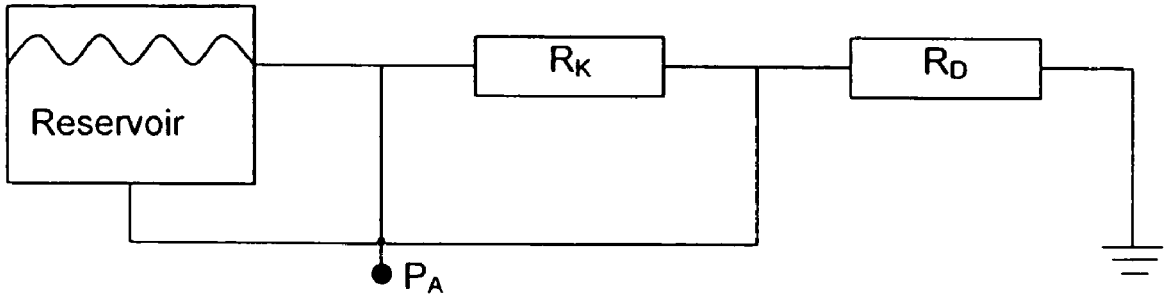
FIG. 3A shows a generalized network model for the dosing system according to the present invention and FIG. 3B shows a network model for a known microdosage system.

FIG. 3A shows a generalized network model, which represents a microdosage device according to the present invention; in FIG. 3A, the resistance RK represents the fluidic resistance of the connecting channel between the nozzle and the reservoir, whereas the flow resistance RD represents the flow resistance of the whole nozzle consisting of the resistance of the nozzle channel and of the resistance of the nozzle opening. PA stands again for the static or dynamic pressure produced by the respective drive unit. In order to achieve in the network model of FIG. 3A a situation in which a volumetric flow of the liquid in the connecting channel is negligible in comparison with the volumetric flow of the liquid in the nozzle channel, the resistance RK will have to be chosen such that it is high in comparison with the flow resistance RD. The ratio of the flow resistances that has to be chosen in a particular case depends on the liquid to be dosed; it should here be pointed out once more that the larger the difference between the resistances is, the greater the bandwidth of the liquids which can be dosed by the same dosage device will be.

Figure 3B:
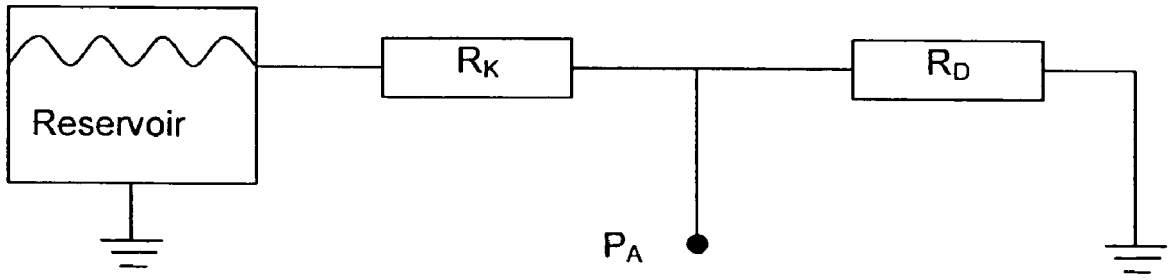

When the reservoir and the nozzle are acted upon by a force of such a nature that a substantially identical pressure is applied to the liquid in the reservoir and in the nozzle, this will guarantee in any case that no return flow through the connecting channel will take place according to the present invention. Such a return flow occurs in known dosage systems of the type described e.g. in the above-mentioned publications DE-A-19706513, DE-A-19802368 or WO 00/62932. A network model representative of the dosage devices shown in the above-mentioned publications is shown in FIG. 3B for the purpose of comparison. It can be seen that, in response to an application of pressure PA, a return flow into the reservoir will there take place in any case, the ratio of the dosed liquid to the liquid flowing back into the reservoir depending on the ratio of the flow resistances RD and RK.

Making again reference to FIG. 1, a dosing operation of the microdosage device shown in said FIG. 1 will now be described in detail. The dosing head 2, which normally comprises a plurality of reservoirs and nozzles, only one reservoir 4 and one nozzle 6 being, however, shown in FIG. 1 because of the sectionwise representation, is first filled with the liquid or liquids to be dosed. This is done by filling the liquids into the reservoir or reservoirs 4 making use of commercially available automatic pipetting devices. The residual lines in the dosing head, i.e. the connecting channel 10, the nozzle channel 20 and the nozzle opening 22, are filled through capillary forces from the respective media reservoirs. As has been mentioned hereinbefore, the nozzle and the nozzle opening 22 are dimensioned such that the liquid is prevented from flowing out on side 24 as well as on side 26 by the surface tension of the liquid in the state of rest.

It should here be pointed out that, in the embodiment shown in FIG. 1, in which the nozzle 6 is provided with a larger cylindrical opening used as a nozzle channel 20 above a small cylindrical opening used as nozzle opening 22, the volume of the nozzle 6 is essentially determined by the larger bore, whereas the flow resistance of the nozzle is essentially defined by the smaller bore. This division of the nozzle into two areas having different diameters is not absolutely necessary for the functioning of the dosage device according to the present invention, but it facilitates the implementation of the dosing head insofar as the desired dosing amount can be adjusted independently of the retention power of the nozzle opening 22 with respect to a hydrostatic pressure in the liquid which may occur during handling and transport.

When the nozzle has been filled completely, this filling being caused by capillary forces in preferred embodiments of the present invention, the dosing head 2 is connected to a drive unit, as schematically shown in FIG. 1 by the elements designated by reference numerals 12 and 14. Making use of the pressure generation means 14, e.g. by opening respective pneumatic valves, an overpressure is then produced in the pressure chamber 12, said overpressure acting uniformly on the whole first side of the dosing head, i.e. the media reservoir 4 and the nozzle 6 are acted upon by a substantially identical pressure from the first side. Due to this overpressure prevailing in the pressure chamber 12, a force is applied to the liquid 8 in the dosing head 2. As soon as the force acting on the liquid in the nozzle opening 22 is large enough for overcoming the surface forces of the liquid at the nozzle opening, the liquid starts flowing out of the nozzle opening 22. A secondary flow of liquid from the reservoir 4 is prevented to a very large extent, provided that the pressure difference between the two ends of the connecting channel 10 is negligible or reproducible, which will be the case when the flow resistances of the connecting channel 10 and of the nozzle channel are dimensioned in accordance with the above explanations. As has been explained hereinbefore, the quantity of a secondary flow from the reservoir will be reproducible in any case, even if the ratio of the flow resistances of the connecting channel and of the nozzle is not sufficiently large for essentially preventing such a secondary flow.

If the flow resistance of the connecting channel is sufficiently high in comparison with the flow resistance of the nozzle and in comparison with the resistance R11, the liquid in the connecting channel will essentially remain in a state of rest, whereas the liquid from the nozzle channel 20 will be ejected through the nozzle opening 22.

In such a dosing process the whole amount of liquid contained in the nozzle can be discharged through the nozzle opening 22, without any movement of the liquid contained in the connecting channel taking place. It follows that the dosed amount of liquid is precisely determined by the geometry of the nozzle. Dosage of the liquid will stop automatically when the nozzle has been emptied completely.

As has already been described, a fluid volume corresponding to the total volume of the nozzle 6 can be discharged from the nozzle opening 22 by actuating the drive unit. It is, however, also possible to eject through said nozzle opening only part of the amount of liquid contained in the nozzle and defined by the geometry of the nozzle, whereas the liquid contained in the connecting channel is not moved or only moved to an insignificant extent.

When the nozzle has been emptied fully or partly, the original condition can be reestablished, after deactivation of the drive unit, by two possibilities, alternatively. Firstly, the pressure chamber can be vented, e.g. by through the valve 16 shown in FIG. 1. Secondly, the pressure generation means can be configured such that it makes use of so-called 3/2-way pneumatic valves so as to permit active ventilation of the pressure chamber by switching over the valves.

If a vent means is not provided or if the drive unit uses mere switching valves, i.e. 2/2-way pneumatic valves, the overpressure can diminish due to a flow of gas through the nozzles when the pressure supply has been switched off.

When the overpressure in the pressure chamber 12 has been reduced to a sufficient extent, the connecting channel 10 and the nozzle 6, i.e. the nozzle channel 20 and the nozzle opening 22, will, due to capillary forces, be refilled from the media reservoir connected thereto, whereupon a renewed dosing process can be carried out.

In order to achieve a neat tearing of the liquid column discharged at the nozzle opening, it will be advantageous to produce in the microdosage device according to the present invention a sufficiently high pressure amplitude in the pressure chamber, whose variation with time should in addition advantageously take place within a very short period so as to achieve a high dynamic of pressure variation. Furthermore, it will advantageous to implement the dosing head and the drive unit such that the discharge of liquid will be finished within a short period of time, e.g. 10 milliseconds, whereas the fluid lines, which are used for refilling on the basis of capillary forces, are implemented such that this process will take much longer, e.g. 100 milliseconds. The two effects will therefore only overlap each other to an insignificant extent and the precision of the dosing volume will not be distorted by the capillary refilling process.

A microdosage device according to the present invention as well as the mode of operation of this device have now been described in general, and, in the following, embodiments and special further developments of this microdosage device will be described in more detail.

Figure 4:
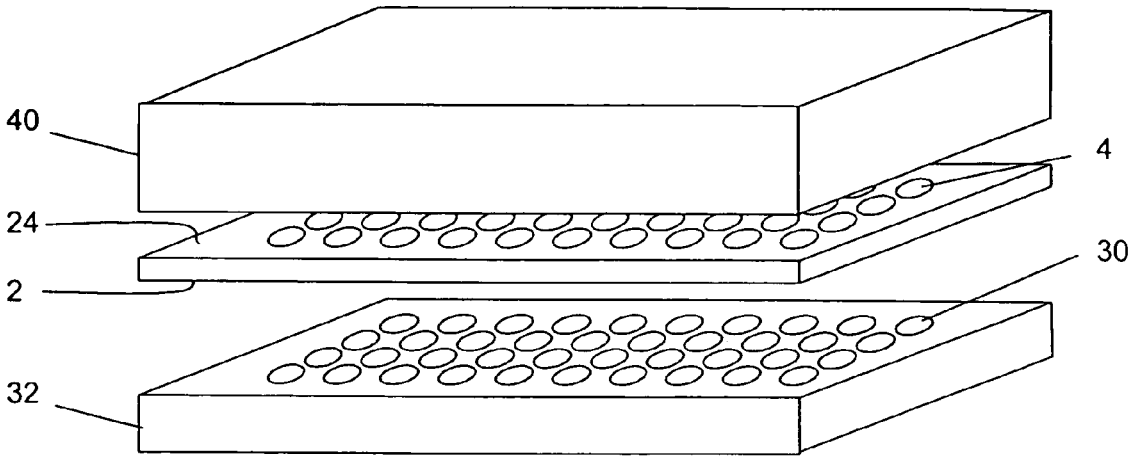
FIG. 4 shows a schematic representation of an embodiment of a microdosage device according to the present invention.

FIG. 4 shows a schematic representation of a microdosage device according to the present invention, which is suitable for simultaneously applying microdroplets to respective locations 30 of a well-plate 32, which can have a conventional raster of reservoirs 30. As can be seen in FIG. 4, the dosing head 2 of the microdosage device is provided with a plurality of media reservoirs 4 in the upper surface 24 thereof. Reference should here be made to the fact that FIG. 4 only shows the media reservoirs 4 formed in the upper surface 24, but does not show the respective associated nozzle ends that are formed in the upper surface 24 as well. Finally, the microdosage device shown in FIG. 4 comprises a drive unit 40 which may, by way of example, have a structural design of the type explained hereinbelow with respect to FIG. 5.

The embodiment shown in FIG. 4 can be used for simultaneously applying a plurality of microdroplets e.g. to a well-plate 32 by simultaneously actuating, by means of the drive unit 40, a plurality of fluid reservoirs 4 having nozzles associated therewith. As can be seen from FIG. 4, the dosing head 2 is, in addition, adapted to be replaced easily and in an automated manner so that different dosing heads and dosing head substrates, respectively, can be used together with the same drive unit 40, as long as the outer dimensions of these dosing heads or dosing substrates are identical or as long as the drive unit is configured for cooperating with dosing head substrates of different outer dimensions.

Figure 5:
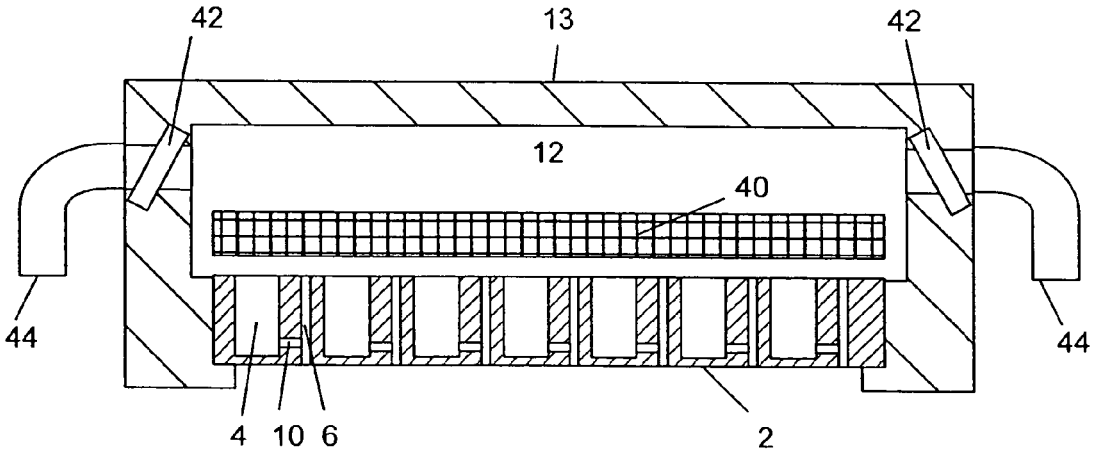
FIG. 5 shows a cross-sectional view of a further embodiment of a microdosage device according to the present invention.

FIG. 5 shows a cross-sectional view of a microdosage device according to the present invention comprising a plurality of media reservoirs 4, nozzles 6 and connecting channels 10, which are formed in a dosing head substrate 2. The drive unit again comprises a pressure chamber 12 having an appropriate housing 13. The housing 13 can be suitably designed in such a way that it is adapted to be attached to the dosing head substrate 2, i.e. in such a way that it is possible to use a replaceable dosing head 2. In the pressure chamber 12 a diffusor 40 is provided, which serves to guarantee a uniform distribution of the pressure to all the reservoirs 4 and nozzles 6. The pneumatic realization of the drive unit shown here additionally comprises fast-switching valves 42 and compressed-air supply lines 44.

Making use of these fast-switching valves 42, it will be possible to generate an overpressure with high dynamic in the pressure chamber 12; by means of this overpressure a driving force is transmitted to the liquids in the dosing head, i.e. it is simultaneously transmitted to the liquids contained in the media reservoirs 4 and in the nozzles 6.

Figure 6:
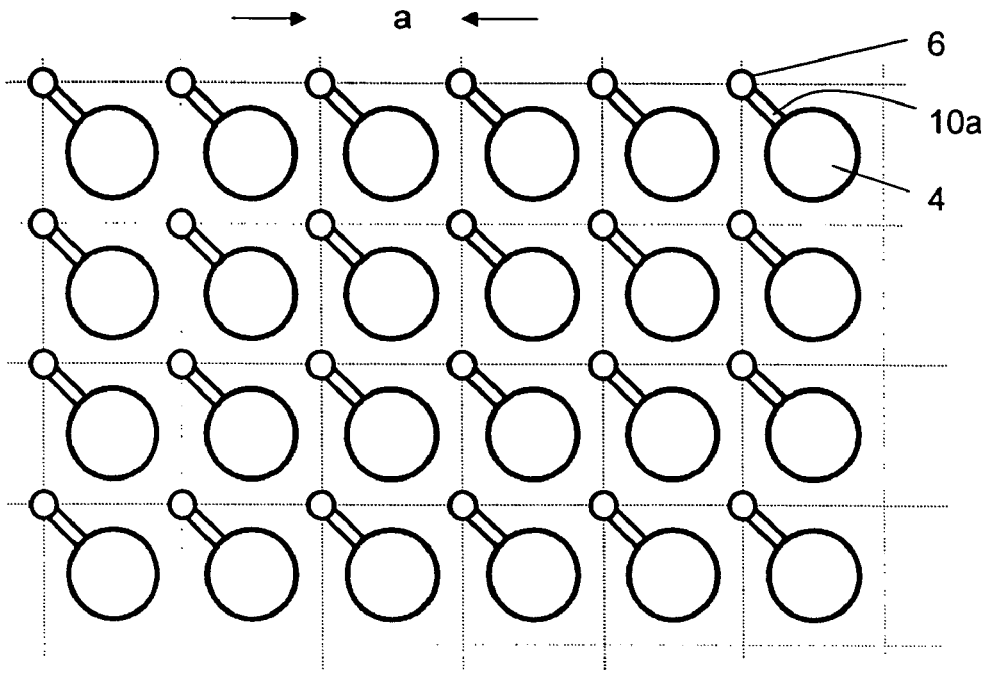
FIGS. 6 and 7 show top views of dosing heads which are adapted to be used in a microdosage device according to the present invention.

FIG. 6 shows a top view of a detail of a dosing head which can be used for a parallel supply of reagents into a well-plate comprising 1536 reservoirs, in the case of which 24 media reservoirs 4, connecting channels 10 and associated nozzles 6 are shown. In order to permit dosage into a 1536 well-plate, the reservoirs 4 as well as the nozzles 6 are arranged with a raster pattern of a=2.25 mm, i.e. in a raster of 2.25×2.25 mm, in the embodiment of a dosing head substrate shown in FIG. 6. Furthermore, the connecting channels 10*a* have a shape which will be explained hereinbelow making reference to FIG. 9A.

Figure 7:
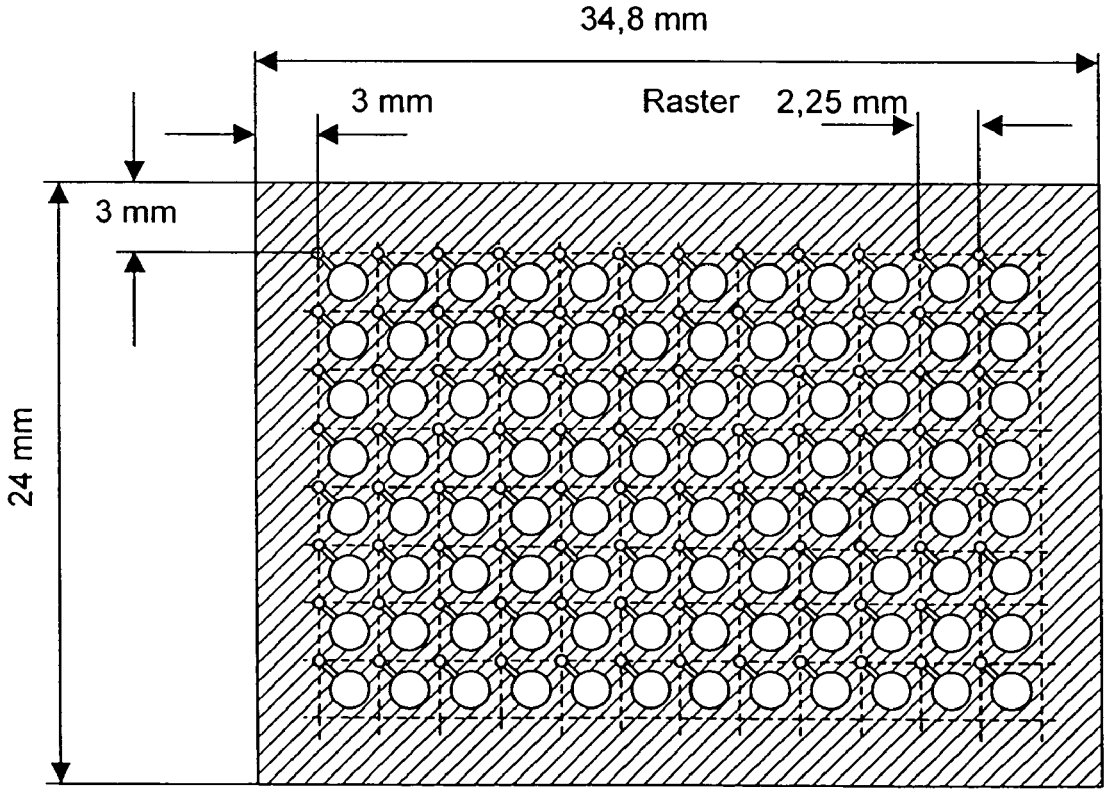

It is evident that a micro-dosing head according to the present invention can comprise an almost arbitrary number of media reservoirs and nozzles; FIG. 7 shows an exemplary dosing head with 96 media reservoirs and associated nozzles having exemplary dimensions.

Reference should here be made to the fact that, according to the present invention, it is not necessary that each nozzle has associated therewith a media reservoir, but that there is, essentially, a freedom of choice insofar as one or a plurality of media reservoirs can be provided which may have connected thereto one or a plurality of nozzles; in this case, a respective media reservoir can be connected to a nozzle via several connecting lines, a media reservoir can be connected to a plurality of nozzles via several connecting lines, and a nozzle can be connected to a plurality of media reservoirs via several connecting lines, as will be explained hereinbelow with reference to FIGS. 10A to 10D. Furthermore, both the reservoirs and the nozzles of the microdosage device according to the present invention can be arranged in different rasters so that a change of format between the format of the reservoirs and that of the receiving receptacle is effected by the dosing process. This permits the use of a conventional pipetting device for filling a well-plate, even if the pipetting device should have a raster pattern which is different from that of the well-plate to be filled.

Figure 8A:
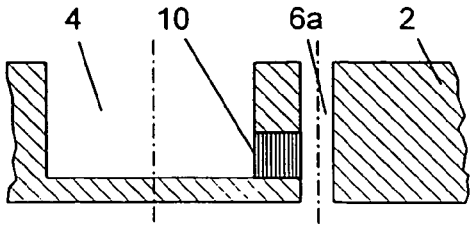
FIGS. 8A to 8D show cross-sectional views showing different designs for nozzles in the microdosage device according to the present invention.

Making reference to FIGS. 8A to 8D, exemplary embodiments of nozzles formed in the dosing head of a microdosage device according to the present invention will now be explained. The simplest embodiment of a nozzle 6*a* is shown in FIG. 8A, where the whole nozzle consists of a single channel having a constant diameter. Depending on the level on which the connecting channel 10 leads into the nozzle 6*a* and on the dimensions of said connecting channel, the resistances R11 and R12, which have been explained hereinbefore with reference to FIG. 2, can be influenced within certain limits in the case of this nozzle 6*a*.

Figure 8B:
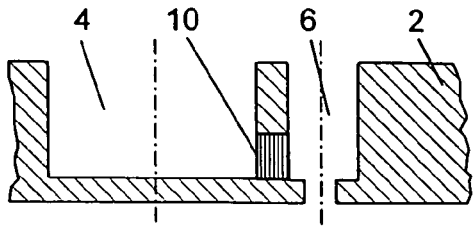

The nozzle 6 shown in FIG. 8B corresponds to the nozzle explained hereinbefore with reference to FIG. 1; the fact that, due to the use of two diameters and two lengths, the nozzle 6 is divided into two sections of different diameters above and below the junction point of the connecting channel 10 provides a variability which facilitates a separate dimensioning of volume, flow resistance and retention power of the nozzle.

Figure 8C:
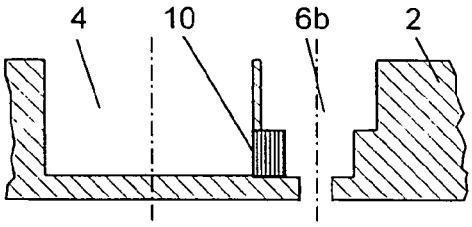

FIG. 8C shows a nozzle 6*b* which is subdivided into three sections. Such a subdivision may be of advantage under circumstances in which not only the dosing volume but also the shape and/or the dynamic of the ejected jet are of importance.

Figure 8D:
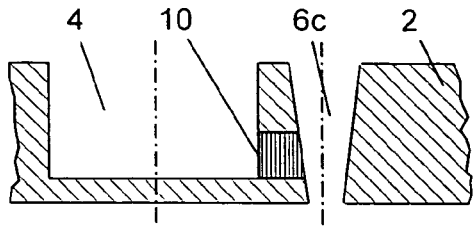

Finally, FIG. 8D shows a nozzle 6*c* having a conical shape.

With respect to the structural design of the nozzle it should, finally, be stated that it is possible to design the nozzle discharge opening as well as the opening located opposite thereto and the nozzle channel, which connects these openings, not circularly but with an arbitrary shape. Deviating from that which is shown in FIGS. 8B to 8D, the diameter of the nozzle channel can, in addition, vary in a depth-dependent manner.

Figure 9A:
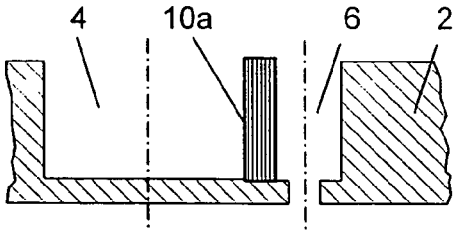
FIGS. 9A to 9D show schematic representations showing different designs of the connecting channel in microdosage devices according to the present invention.

Various design possibilities for the connecting channel interconnecting the interior reservoirs and the nozzles are shown in FIGS. 9A to 9D. Depending on the respective case of use, the connecting channel can be adapted with respect to its routing as well as with respect to its diameter. In FIG. 9A a channel 10*a* is shown, which is open towards the top of the dosing head. Such a channel is used in the embodiments of a dosing head shown in FIGS. 6 and 7. Also this possibility of designing a channel permits the microdosage device to be operated according to the above-described principle and has advantages with respect to a simple production as well as the advantage that gas bubbles in the connecting channel can escape very easily.

In the example shown, a circular reservoir 4 is connected to the nozzle 6 by a rectangular connecting channel 10*a*, the reservoir and the connecting channel having the same depth so as to guarantee that the reservoir will be emptied completely.

Figure 9B:
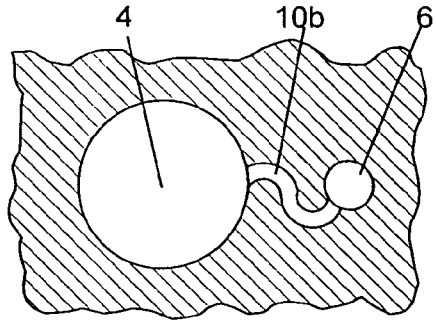

FIG. 9B shows a sectional view of a dosing head substrate in a plane of the substrate. In the portion shown, a media reservoir 4 and a nozzle 6 can be seen, which are interconnected by a curved channel 10B. In addition to the non-straight routing of channel 10B shown in FIG. 9B, other arbitrary routings are possible, in particular meandrous routings being used so as to realize an increase in the flow resistance between the media reservoir and the nozzle.

The connecting channel between the media reservoir and the nozzle may, in addition, have arbitrary cross-sections and need not necessarily be rectangular. Finally, the cross-section may become larger or narrower in the course of the channel, and it would also be possible to provide e.g. two or more connecting channels between the same reservoir and the same nozzle.

Figure 9C:
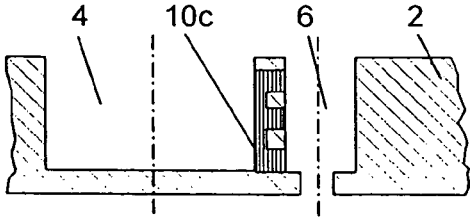
Figure 9D:
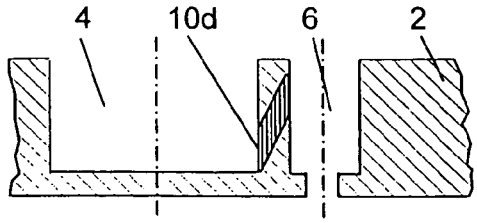

Such an embodiment is shown in FIG. 9C where the channel is defined by three subchannels 10*c*. In addition, the channel need not extend parallel to the surface of the dosing head, but it may be routed in an arbitrary manner within the dosing head, an obliquely extending channel 10*d* being shown in FIG. 9D. As far as the channel is concerned, it should only be taken into account that said channel must not establish a direct connection to the bottom side of the dosing head, but only a connection via the nozzle. In addition, the flow resistance of the connecting channel must be larger than the flow resistance of the nozzle.

FIGS. 10A to 10D show different possibilities for arranging the fluidic components, i.e. media reservoir, connecting channel and nozzle, in the dosing head of the microdosage device according to the present invention. To begin with, it should be pointed out that not all the elements, e.g. media reservoirs, provided in a dosing head have to have the same dimensions. This applies to the connecting channels and nozzles as well. Especially nozzles containing different volumes can be accommodated on the same dosing head. In addition, design possibilities exist insofar as the number of nozzles and reservoirs need not be identical, but that a plurality of nozzles can be connected to one or several reservoirs or that a plurality of reservoirs can be connected to one or several nozzles.

Figure 10A:
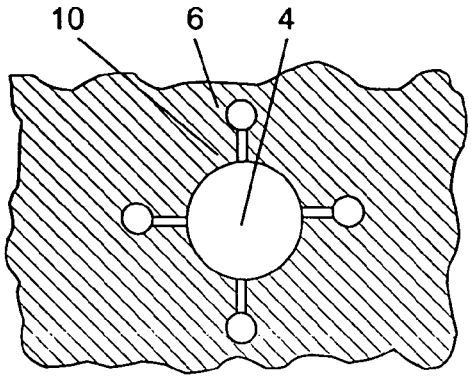
FIGS. 10A to 10D show schematic top views of dosing head substrates and of portions of such substrates, which are adapted to be used in microdosage devices according to the present invention.
Figure 10B:
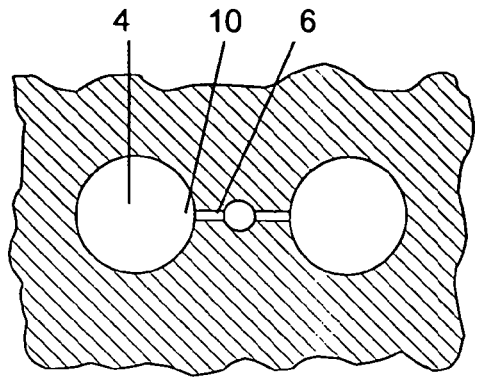
Figure 10C:
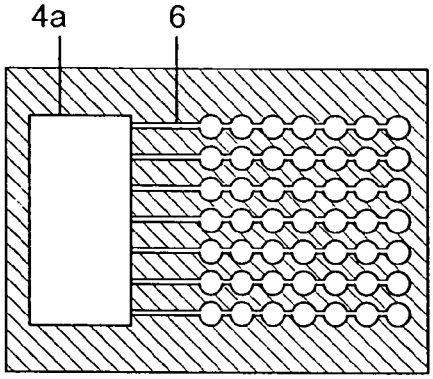

FIG. 10A shows a schematic representation of a dosing head section in which a media reservoir 4 is connected via four connecting channels 10 to four nozzles 6. According to FIG. 10B, two media reservoirs 4 are connected to a nozzle 6 via a respective connecting channel 10. In this example, it is possible to mix the liquids originating from the two reservoirs 4 within the nozzle 6 prior to a respective dosing process. In an extreme case, an arrangement is additionally possible in the case of which all the nozzles 6 are filled from a single media reservoir 4*a*, as shown in FIG. 10C.

Figure 10D:
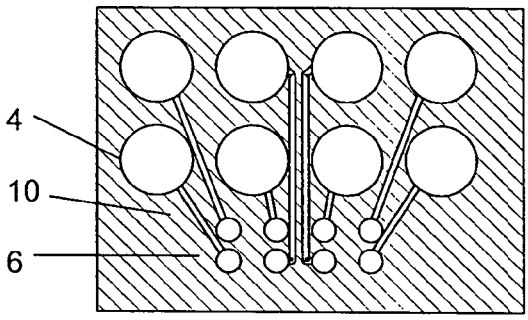

Irrespectively of whether an identical number of nozzles and reservoirs is provided, a change of format can be effected by the dosing head in any case. This means that the distance between the individual nozzles and the distance between the individual reservoirs can be different. One example of such an arrangement with broad distances between the reservoirs 4 and narrow distances between the nozzles 6 is shown in FIG. 10D, where, in this example, each nozzle 6 is connected to an associated media reservoir 4 via a connecting channel 10.

Figure 11A:
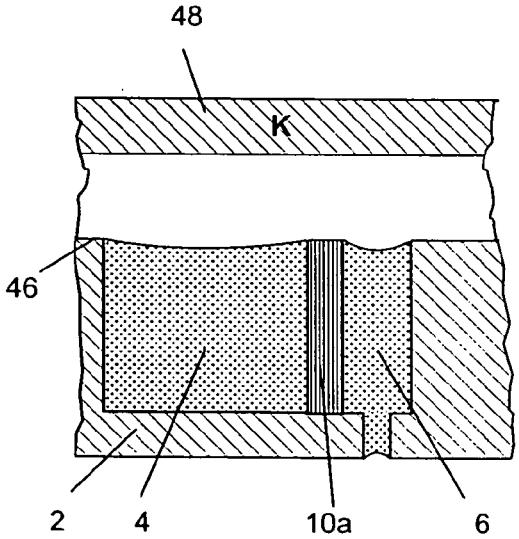
FIGS. 11A and 11B show schematic cross-sectional views for illustrating a drive unit that is adapted to be used in accordance with the present invention.
Figure 11B:
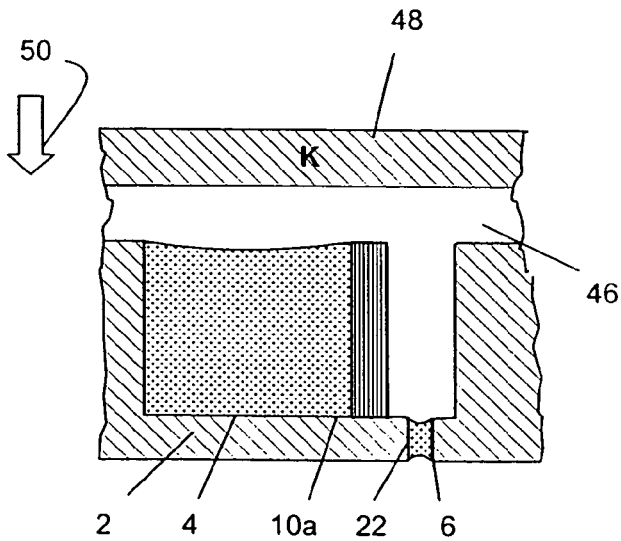

FIGS. 11A and 11B show an alternative embodiment of a drive unit that can be used in accordance with the present invention.

As can be seen from the fragmentary, schematic, cross-sectional views shown in FIGS. 11A and 11B, the dosing head has the structural design, which has been described hereinbefore with reference to FIG. 9A, as far as the media reservoir 4, the connecting channel 10*a* and the nozzle 6 are concerned. Other than in the case of the embodiments described with reference to FIGS. 1 and 5, the force required for dosing is now applied by means of a system liquid 46 to the liquid to be dosed which is contained in the media reservoir 4 and in the nozzle 6. The system liquid 46 must be of such a nature that it will not mix with the liquid to be dosed and it must have a negative surface energy on the surface of the dosing head, i.e. it must not be drawn into the nozzle by capillary forces. As can be seen in FIGS. 11A and 11B, a piston 48 is provided for applying a force to the system liquid 46 in the direction of the arrow 50. Alternatively, it is possible to provide any other displacer which is adapted to be used for applying to the media reservoir and the nozzle a force of such a nature that substantially identical pressure conditions will be generated in these elements.

Through the system liquid 46, the force is applied to the liquid to be dosed, whereupon the dosing process will take place. FIG. 11B shows the microdosage device after the ejection of the desired amount of liquid, this amount of liquid being determined by the displaced volume. As can be seen in FIG. 11B, the system liquid 46 does not penetrate into the nozzle opening 22, nor is it drawn into the nozzle opening by capillary forces. After the ejection of the desired amount of liquid, the displacer or piston 48 is returned to its starting position, the hydrophobic system liquid 46 being displaced from the nozzle by capillary forces in the course of this process. This has the effect that the original condition, which is shown in FIG. 11A, is reestablished.

As can clearly be seen from the above explanations, the dosed volume according to the present invention is determined by the volume of the nozzle, either only in the nozzle channel or in the nozzle channel and in the nozzle opening, and is essentially independent of the properties of the fluid. The present invention permits a precise discharge of e.g. approx. 50 nl in a single dosing process, provided that the channels and openings are designed appropriately.

Although preferred embodiments of the present invention have been explained in more detail hereinbefore, it is evident that further modifications and changes of these embodiments are possible. It is, for example, possible to use alternative drive units so as to exert a driving force on the liquid. In addition to the described application of a homogeneous, pneumatic or hydraulic pressure in the area of the first side of the dosing head, it is also possible to apply a negative pressure to the second side of the dosing head so as to suck the liquid from the nozzle opening. Still another alternative is a volume displacement of liquid on the first surface of the dosing head, one example of such a volume displacement being the embodiment which makes use of the system liquid 46 and which has been described making reference to FIGS. 11A and 11B. Furthermore, electrostatic or electromagnetic forces acting directly on the liquid, or arbitrary other forces acting directly or indirectly on the liquid can be used. The force required for operating the microdosage device can be applied electromagnetically, provided that the liquid to be dosed has an electric charge or a sufficient dipole moment. By applying suitable electromagnetic fields between the dosing head and the receptacle, i.e. normally the well-plate, a force can in this case be exerted on the fluid in the direction of the well-plate. The dosing process will then start as soon as the electromagnetic force overcomes the surface forces of the nozzle opening.

It need not be specially mentioned that the plurality of reservoirs of the dosing head used according to the present invention can be filled with identical or different liquids so that identical or different liquids can be discharged simultaneously. Furthermore, it is clear that the dosing heads used according to the present invention can be produced with the aid of arbitrary conventional methods. The dosing head can, for example, be produced from silicon by micromechanical methods. Alternatively, also other known methods, such as micro-injection moulding, hot-process embossing, or methods in the case of which individual layers are adhesively connected or laminated may be used.

The dosage device according to the present invention can be operated either as a dosage device for discharging an amount of liquid predefined by the geometrical volume of the nozzle channel, or as a device having a small but variable volume. In the first case, the driving force acting on the liquid is maintained until the whole amount of liquid contained in the nozzle has been ejected through the nozzle opening. Dosing will stop automatically in this case, since, due to the diminishing pressure gradient, liquid will not be resupplied by the drive unit. In the second case, the driving force applied by the drive unit will be switched off before the liquid has been ejected completely from the nozzle.

It follows that the dosed amount of fluid can be controlled either by the structural shape, i.e. by the volume contained in the nozzle, or by the duration and by the course of the driving force applied by the drive unit. In the first case, the dosed amount of liquid is essentially independent of the physical properties of the liquid, such as viscosity and surface tension. In the second case, the dosed volume will be influenced by these parameters. It is therefore advisable to carry out a calibration in the last-mentioned case so as to achieve a precise dosage, since the dosage of different liquids with different viscosities will take different periods of time. These different periods of time will have to be taken into account if the dosed volume is not the whole nozzle volume, whereas they are of secondary importance in cases in which the whole nozzle volume is discharged, so that the dosing process will stop automatically as soon as the whole amount of liquid corresponding to the predefined volume has been ejected.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as falling within the true spirit and scope of the present invention.

What is claimed is:

1. A microdosage device comprising: a media reservoir used for accommodating a liquid to be dosed; a nozzle connected via a connecting channel to the media reservoir and adapted to be filled via said connecting channel with the liquid to be dosed; and a drive unit for applying, when actuated, to a liquid contained in the media reservoir and in the nozzle a force of such a nature that a substantially identical pressure will be exerted on said liquid contained in the media reservoir and in the nozzle, wherein flow resistances of the connecting channel and of the nozzle are dimensioned such that, in response to an actuation of the drive unit, a volumetric flow in the connecting channel will be small in comparison with a volumetric flow in the nozzle, said volumetric flow in the nozzle causing an ejection of the liquid to be dosed from an ejection opening of the nozzle.

2. A microdosage device according to claim 1, wherein the flow resistance of the connecting channel is larger than the flow resistance of the nozzle.

3. A microdosage device according to claim 1, wherein the nozzle comprises a nozzle channel into which the connecting channel ends, the flow resistance of the connecting channel being higher than the flow resistance of the nozzle channel between the location where the connecting channel ends into said nozzle channel and a location at which the liquid in the nozzle channel is acted upon by the force.

4. A microdosage device according to claim 1, comprising a dosing head in which the media reservoir and the nozzle are formed, wherein the nozzle comprises a nozzle channel having an ejection opening and an actuating opening, wherein the media reservoir has a media reservoir opening, and wherein the actuating opening as well as the media reservoir opening are formed in a same surface of the dosing head.

5. A microdosage device according to claim 4, wherein the drive unit comprises a pressure generation means for simultaneously applying a substantially uniform pressure to the media reservoir opening and the actuating opening.

6. A microdosage device according to claim 5, wherein the drive unit is provided with a pressure chamber which is adapted to be filled with a buffer medium, the buffer medium being adapted to be used for applying the pressure to the media reservoir opening and the actuating opening.

7. A microdosage device according to claim 1, which comprises a plurality of nozzles and one or a plurality of media reservoirs, wherein the drive unit is configured for actuating said plurality of nozzles, and wherein each of said plurality of nozzles is in fluid connection with one or a plurality of media reservoirs through one or a plurality of connecting channels.

8. A microdosage device according to claim 7, wherein at least one of said plurality of nozzles and said plurality of reservoirs are arranged in a raster which corresponds to the format of a well-plate.

9. A microdosage device according to claim 8, wherein a plurality of media reservoirs is arranged in a first raster, and wherein a plurality of nozzles is arranged in a second raster, so that a change of format takes place between said media reservoirs and said nozzles.

10. A microdosage device according to claim 1, which comprises a plurality of media reservoirs and one or a plurality of nozzles, wherein each media reservoir is in fluid connection with one or a plurality of nozzle openings through one or a plurality of connecting channels.

11. A microdosage device according to claim 1, wherein the nozzle and the connecting channel are implemented such that the nozzle will be filled from the media reservoir via the connecting channel due to capillary forces and without any actuation of the drive unit.

12. A method for dosing small amounts of liquid, said method comprising the following steps:

providing a microdosage device comprising: a media reservoir used for accommodating a liquid to be dosed; a nozzle connected via a connecting channel to the media reservoir and adapted to be filled via said connecting channel with the liquid to be dosed; and a drive unit for applying, when actuated, to a liquid contained in the media reservoir and in the nozzle a force of such a nature that a substantially identical pressure will be exerted on said liquid contained in the media reservoir and in the nozzle, wherein flow resistances of the connecting channel and of the nozzle are dimensioned such that, in response to an actuation of the drive unit, a volumetric flow in the connecting channel will be small in comparison with a volumetric flow in the nozzle, said volumetric flow in the nozzle causing an ejection of the liquid to be dosed from an ejection opening of the nozzle;

filling the least one nozzle via the connecting channel with a liquid to be dosed from the media reservoir, said connecting channel establishing a fluid connection between said nozzle and said media reservoir; and applying to the liquid contained in the media reservoir and in the nozzle a force of such a nature that a substantially identical pressure will be applied to the liquid contained in the media reservoir and in the nozzle, so that, due to the dimensioning of flow resistances of the connecting channel and of the nozzle, the volumetric flow in the connecting channel will be small in comparison with the volumetric flow of the liquid in the nozzle so as to eject an amount of the liquid to be dosed from an ejection opening of the nozzle.

13. A method according to claim 12, wherein the step of filling comprises a step of filling the nozzle on the basis of capillary forces in the connecting channel and in the nozzle.

14. A method according to claim 12, wherein the step of applying a force to the liquid contained in the media reservoir and the nozzle comprises the step of simultaneously applying a substantially identical pressure to openings of the media reservoir and of the nozzle.

15. A method according to claim 12, wherein the step of applying a force to the liquid contained in the media reservoir and in the nozzle comprises the step of causing a volume displacement at openings of the media reservoir and of the nozzle.

16. A method according to claim 12, wherein the step of applying a force to the liquid contained in the media reservoir and in the nozzle comprises the step of applying an electric or a magnetic field.

17. A method according to claim 12, wherein the step of filling comprises the step of filling a plurality of nozzles with different liquids from a plurality of media reservoirs, and wherein the application step comprises the step of simultaneously applying a force to said plurality of nozzles and said plurality of media reservoirs so that different liquids will be ejected simultaneously through the nozzles.

* * * * *